United States Patent [19]

Weiss

[11] 4,106,297

[45] Aug. 15, 1978

[54] METHOD OF AND AN ARRANGEMENT FOR ESTABLISHING AN UNDERGROUND PASSAGE

[76] Inventor: Richard Weiss, Endstrasse 7, 4130 Moers, Fed. Rep. of Germany

[21] Appl. No.: 725,137

[22] Filed: Sep. 17, 1976

[30] Foreign Application Priority Data

Oct. 17, 1975 [DE] Fed. Rep. of Germany ..... 2546491

[51] Int. Cl.[2] ..... E21D 9/00

[52] U.S. Cl. ..... 61/42; 61/84

[58] Field of Search ..... 61/42, 72.7, 84, 85; 299/10

[56] References Cited

U.S. PATENT DOCUMENTS

| | | | |
|---|---|---|---|
| 1,380,400 | 6/1921 | McArthur | 61/42 |
| 1,896,439 | 2/1933 | Dunlop | 61/42 X |
| 1,948,707 | 2/1934 | Gilman | 61/84 X |

*Primary Examiner*—Paul R. Gilliam
*Assistant Examiner*—David H. Corbin
*Attorney, Agent, or Firm*—Michael J. Striker

[57] ABSTRACT

An arrangement for establishing an underground passage includes a first line of consecutive pipe sections which are pressed through the ground in a path which deviates from the desired course of the passage whenever the first line of pipe sections encounters an obstruction. A second line of the consecutive pipe sections follows the trailing end of first line, and a planing tool support carrying at least one planing tool is interposed between the trailing end of the first line and the leading end of the second line of consecutive pipe sections. The planing tool extends transversely beyond the planing tool support and removes the excess material between the actual path and the desired course, and the removed excess material is deposited between the previous path and the second line of consecutive pipe sections and cemented therein by the introduction of a cementing material into such deposited excess material. The pipe sections from the leading end of the first line can be removed and transported to the trailing end of the second line to be added thereto as the two lines are advanced. The planing tool support is coaxially mounted at the trailing end of the first line, and anti-friction bearings may be interposed between the planing tool support and the leading end of the second line. At least one cylinder-and-piston unit may extend between the planing tool support and the leading end of the second line.

7 Claims, 3 Drawing Figures

METHOD OF AND AN ARRANGEMENT FOR ESTABLISHING AN UNDERGROUND PASSAGE

BACKGROUND OF THE INVENTION

The present invention relates to a method of and an arrangement for establishing underground passages in general, and more particularly to establishing underground passages which are either horizontal or have a predetermined slope along their course.

There are already known various methods of establishing underground passages, including those for establishing lined tunnels, underground channels, adits or drifts, and so on. Many of these methods and many arrangements for performing such methods are rather complex and laborious. There is, however, already known a relatively simple method of establishing such underground passages, which resides in advancing a line of consecutive pipe sections through the ground, provided that the latter is sufficiently yieldable to permit penetration of the line of pipe sections therethrough. The present invention is primarily concerned with underground passages which have been established in this advancing process.

As already mentioned above, this conventional advancing process of establishing undergound passages is rather simple and the necessary equipment for performing such a process also has a very low degree of complexity. However, experience with this advancing process has shown that it is possessed of one rather serious drawback when used in connection with establishing, for instance, underground draining passages or the like. More particularly, such passages are, more often than not, to be established in regions where the earth surface is flat or has only a minute inclination with respect to the horizontal. Under these circumstances, it is necessary to give the underground passage a quite minute slope in order to assure natural flow of water or similar liquid therethrough. Such inclination amounts, for instance, to 6 centimeters per 100 meters of length of the underground passage or channel. It will be appreciated that close adherence to this inclination in all regions of the underground passage is imperative especially under these circumstances.

When the underground passage is established in the advancing process which has been mentioned previously, it will often happen that the leading end of the line of consecutive pipe sections which is being advanced through the ground meets some obstructions as it is being advanced along the desired course of the passage, such as rocks, boulders and the like. When encountering such obstructions, first the leading end of the line of consecutive pipe sections and subsequently the line in its entirety will be easily deflected from the desired course and will continue its advancement in a path which is offset from the desired course at least in the immediate vicinity of the obstruction. However, inasmuch as it is very difficult if not impossible to immediately detect the deviation of the leading end of the line of pipe sections from the desired course and to take immediate corrective measures, a situation arises in which, for instance, a boulder which extends to the extent of several centimeters into the desired course causes a deviation from the desired course of the advancing line of consecutive pipe sections which amounts to several decimeters, inasmuch as the leading end of the line of consecutive pipe sections or a cutting arrangement provided thereon, and the following consecutive sections, due to their inflexibility, have to gradually glide over the above-mentioned boulder and can be deflected toward the original desired course only after passing the boulder or other obstruction. This is true even when the deflection of the leading end of the line of consecutive pipe sections is detected immediately and the corrective measures are attended to at the first opportunity. The situation is even worse when the deviation of the path of advancement of the consecutive pipe sections from the desired course is detected only after a certain period of time has elapsed subsequent to the encounter with the obstruction.

When such a deviation of the advancement path from the desired course occurs in a horizontal plane, it can be often accepted inasmuch as it may be of no consequence that the underground passage is slightly curved in the horizontal plane. However, when such a deviation occurs only or also in a vertical plane this may have very serious consequences, particularly in the above-mentioned circumstances where it is imperative that the desired inclination or slope of the underground passage be maintained. The existence of even one substantial deviation from the desired course in the vertical direction, which may be the result of a quite insubstantial projection of an obstruction into the desired course, anywhere along the passage which may be quite long, may render the entire passage useless inasmuch as the water or a similar fluid will tend to accumulate upstream of the location of the deviation, such deviation, in effect, resulting in the formation of a dam which may prevent the passage of the water or similar fluid through the passage altogether. Inasmuch as such deviations cannot be avoided during the advancing process in ground or soil which may contain scattered obstructions, it was heretofore necessary to abandon the underground passage which included such a deviation from the desired course, and to establish another underground passage next to the abandoned passage. This approach, however, is very expensive, particularly in terms of manhours, results in unnecessary wear of the machinery which is used for performing the advancing process, and sometimes cannot be used at all, particularly in crowded conditions where there is simply no space available for establishing the additional, hopefully correct, underground passage.

SUMMARY OF THE INVENTION

Accordingly, it is a general object of the present invention to avoid the disadvantages of the prior art.

More particularly, it is an object of the present invention to provide a method of establishing an underground passage which is simple to perform and achieves excellent results.

A further object of the present invention is to devise a method of establishing an underground passage which has a constant, even though small, incline along its entire length.

A concomitant object of the present invention is to provide an arrangement which is capable of performing the above-discussed method.

Yet another object of the present invention is to so construct such arrangement as to be simple in construction and sturdy and reliable in operation.

It is still another object of the present invention to provide an arrangement of the above-discussed type which is capable of eliminating excess material from regions where the path of advancement of a line of consecutive pipe sections which is being advanced through the ground deviates from the desired course of the passage in the vertical direction.

In pursuance of these objects and others which will become apparent hereafter, one feature of the present invention resides, briefly stated, in a method of establishing an underground passage which comprises the steps of advancing a line of consecutive pipe sections through the ground in a path which deviates from the desired course of the passage when said line encounters an obstruction during the advancement thereof; and removing the excess material located between said path and said course.

Advantageously the method further comprises the steps of advancing an additional line of consecutive pipe sections in the above-mentioned course behind the first-mentioned line when considered in the advancement direction of the latter. Then, the removing step may include severing the excess material by using at least one severing tool arranged between the trailing end of said first-mentioned line and the leading end of said additional line as considered in the advancement direction, the severing including advancing the severing tool which is shaped as a planing tool together with said lines. The severing or planing tool will then extend transversely beyond the first-mentioned line of consecutive pipe sections, particularly in the downward direction, and will sever the excess material to the desired extent so that the following additional line of consecutive pipe sections will be advanced in the desired course rather than in the previously established path.

The method of the present invention is very advantageous in that it avoids the previously existing need for advancing an additional line of consecutive pipe sections next to a previously established passage which deviates from the desired course at one or more locations. Rather, the method of the present invention renders it possible to remove the excess material at the locations where the path of advancement of the line of consecutive pipe sections deviates from the desired course as a result of encountering an obstruction, in a very simple manner, right after establishing the original passage or at any convenient time thereafter, so as to conform the position of the line of consecutive pipe sections to the desired course by correcting the regions of the deviation from the same.

In order to avoid the necessity of transporting the removed excess material through the passage to the leading or the trailing end thereof for removal out of the same, it is further advantageous according to a further aspect of the present invention to deposit the severed excess material in a space between the additional line of consecutive pipe sections and the boundary of the previously established path.

The severed material deposited in said space can be stabilized, such as by introducing a cementing material into said space to penetrate into the deposited material. The stabilizing or bonding agent may be, for instance, a cement suspension or the like.

It is also possible, according to a further concept of the present invention, to manage substantially with those pipe sections that have been originally advanced, by removing pipe sections from the leading end of the original, incorrectly advanced, line of consecutive pipe sections, transporting the removed sections to the trailing end of the following additional line of consecutive pipe sections, and adding the transported pipe sections to the trailing end of such additional line for advancement therewith.

A further feature of the present invention resides in an arrangement for establishing an underground passage in accordance with the above-discussed method, which arrangement comprises a line of consecutive pipe sections which advance through the ground in a path which deviates from the desired course of the passage when said line encounters an obstruction during advancement thereof, and means for removing the excess material located between said path and said course. More particularly, the removing means of the arrangement includes at least one planing tool which is mounted at the trailing end of said line of consecutive pipe sections and extends transversely thereof beyond the outer contour of the line. The removing means may further include a planing tool support which has transverse dimensions corresponding to those of the said pipe sections and arranged at said trailing end, said planing tool being mounted on said planing tool support. The removing means may further include means for adjusting the extent to which the planing tool extends transversely beyond said planing tool support, the latter being substantially tubular and hollow and including at least one opening through which said planing tool extends from the interior to the exterior of said planning tool support.

The planing tool support has a support portion which is inclined forwardly in the advancement direction and in the radially outward direction, the planing tool being supported on said support portion parallel thereto for adjustment of its position thereon by the adjusting means. The planing tool may have a plurality of planing tool sections each of which is adjustably supported on said support portion of said planing tool support, which is very advantageous for adjusting the planing tool sections so as to take into account the local conditions and requirements at any location where the planing tool is to be used for removing the excess material. The independent adjustability of the planing tool sections renders it possible to remove the excess material to different extents at any given location by accordingly adjusting the positions of the planing tool sections.

The planing tool support has to have a sufficient degree of rigidity, which is achieved, according to the present invention, by constructing the planing tool support of a pair of annular end members, a plurality of tubular members extending between said end members and parallel to one another and to the advancement direction, and a tubular sheet metal jacket curved in conformity with the outer periphery of said end members and extending between the latter. The jacket may be circumferentially incomplete to provide an opening for passage of the planing tool or the planing tool sections therethrough.

The planing tool support may further have a guide ring at an end face thereof which faces the trailing end of the upstream line of consecutive pipe sections and adapted to circumferentialy embrace said trailing end.

The arrangement may further comprise an additional line of consecutive pipe sections which follows the first-mentioned line as considered in the advancement direction of the latter. Under these circumstances, antifriction bearing means may be interposed between the planing tool support and the leading end of the additional line of consecutive pipe sections. The bearing means may include a plurality of rollers supported at the end of the planing tool support which faces said leading end of said additional line, the rollers being in rolling contact with said leading end of said additional line of consecutive pipe sections. The leading end of said additional line of consecutive pipe sections may include a ring-shaped member connected thereto, the rollers being in rolling contact with said ring-shaped member.

The leading end of the additional line of consecutive pipe sections may further include a sleeve-shaped member which circumferentially surrounds said ring-shaped member and a leading end of a leading section of said additional line to connect the ring-shaped member and the leading section to one another. At least one cylinder-and-piston unit may be arranged at and extend between the planing tool support and the leading end of the additional line of consecutive pipe sections, being operative for adjusting the radial position of the additional line relative to the planing tool support.

At least one of the consecutive sections of the additional line may be formed with at least one opening which is operative for injection of a cementing material therethrough into a space between the consecutive sections and the boundary of said path. The arrangement may further comprise means for introducing the removed excess material into said space, the cementing material then stabilizing the introduced material in said space.

At least one pair of additional planing tools may be mounted on the planing tool support, such additional planing tools extending in the direction transverse to the direction in which the first-mentioned planing tool extends and beyond the planing tool support to the two sides of the first mentioned planing tool, and the jacket of the planing tool support may be provided with circumferentially extending slots for passage of the additional planing tools therethrough.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

A DETAILED DISCUSSION OF THE PREFERRED EMBODIMENTS

Figure 1:
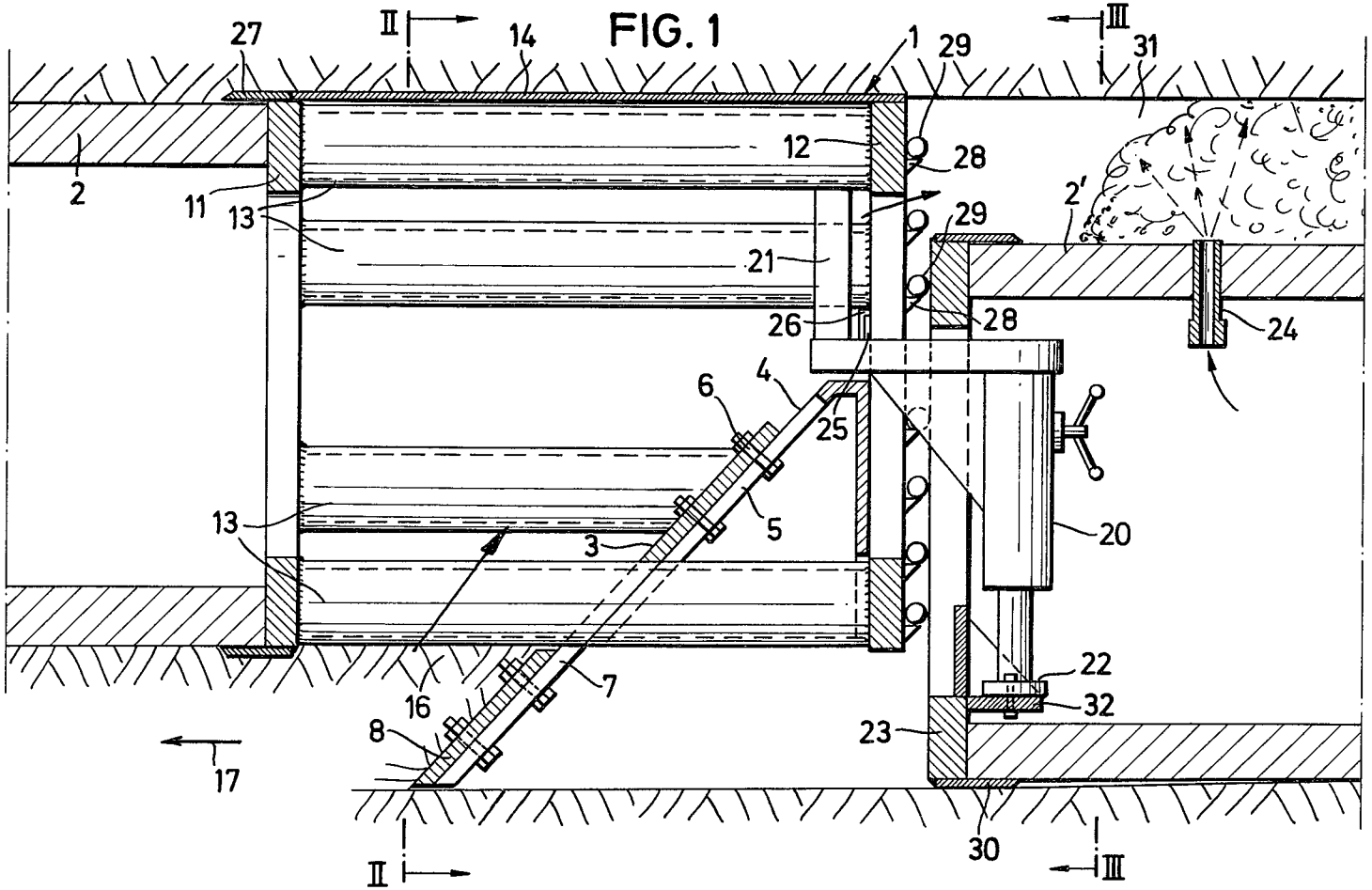
FIG. 1 is a longitudinal sectional view of a portion of the arrangement of the present invention, including a planing tool support and a planing tool mounted thereon and shown in an extended position thereof.
Figure 3:
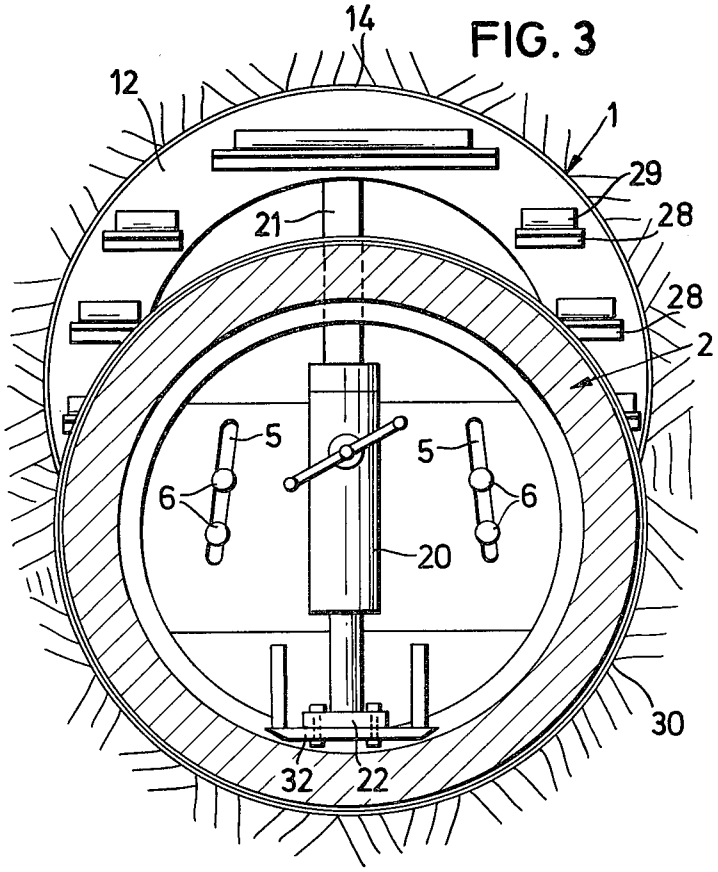
FIG. 3 is a cross-sectional view taken on line III—III of FIG. 1.

Referring now to the drawings in detail, and first to FIG. 1 thereof, it may be seen that the arrangement for establishing an underground passage according to the present invention, particularly in advancing process, includes a first or upstream line of consecutive pipe sections 2, and a second or downstream line of consecutive pipe sections 2'. A planing tool support, designated in toto with a reference numeral 1, is interposed between the trailing end of the upstream pipe section 2 and the leading end of the downstream pipe section 2'. The planing tool support 1 has generally the same outer contour as the pipe sections 2 and 2', and has at least one opening 15 (see FIG. 2) for at least one planing tool 3 which is adjustably mounted on the planing tool support 1. As further seen in FIG. 2, the planing tool 3 may be composed of a plurality of adjacent planing tool sections 3*a*, 3*b*, and 3*c*; such planing tool sections either being juxtaposed with one another, or overlapping each other.

As particularly seen in FIG. 1, the planing tool 3 or, for that matter, the planing tool sections 3*a*, 3*b* and 3*c* thereof may be adjustably mounted on a support portion 4 rigid with the planing tool support 1, which support portion 4 is inclined in the radially outward and forward direction of the planing tool support 1, the forward direction coinciding with the advancement direction of the pipe sections 2 and 2' and the planing tool support 1 and being designated with the reference numeral 17.

Figure 2:
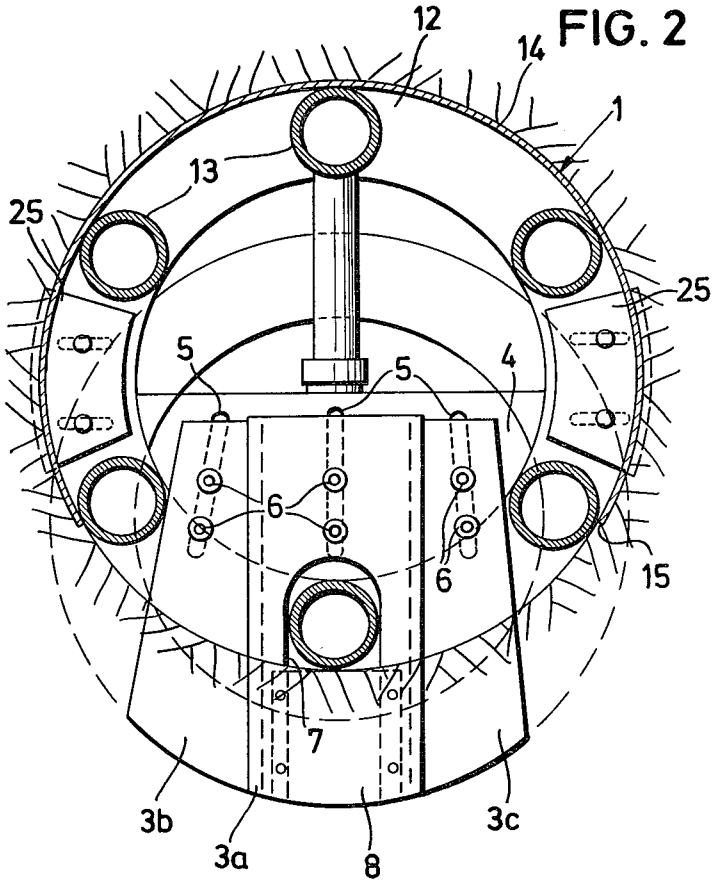
FIG. 2 is a cross-sectional view of the arrangement taken on line II—II of FIG. 1.

The adjustable mounting of the planing tool 3 or of the planing tool sections 3*a*, 3*b* and 3*c* may be accomplished in a manner illustrated in FIG. 2 by means of screws 6 or similar holding elements which are received in elongated slots 5 formed in the support portion 4. Of course, the slots 5 could also be provided in the planing tool 3 itself or in the sections 3*a*, 3*b* or 3*c* thereof, if so desired or if convenient for manufacturing or other reasons. Inasmuch as different screws 6 connect the respective sections 3*a*, 3*b* or 3*c* to the support portion 4, it will be appreciated that each of the planing tool sections 3*a*, 3*b* and 3*c* can be adjusted to the desired extent independently of the other sections 3*a*, 3*b* and 3*c*.

The central planing tool section 3*a* includes a relatively wide-slot-shaped opening 7, the opening 7 having a lower open end which is closed by an interchangeable plate 8 of proper dimensions.

The planing tool support 1 includes a pair of end rings 11 and 12, and a plurality of tubular elements 13 of steel or a similar rigid material, which tubular elements extend in parallelism with one another and also parallel to the advancement direction 17. The tubular elements 13 are connected to the end rings 11 and 12, respectively and thus interconnect the same with one another. The tubular elements 13 are spaced from one another in the circumferential direction of the planing tool support 1, and are partially surrounded by an arcuate or partly cylindrical jacket 14 of steel or metal sheet, the jacket 14 extending from one of the end rings 11 to the other end ring 12. The jacket 14 has an inner contour which corresponds to the outer periphery of the respective rings 11 and 12, and an outer contour which generally corresponds to the outer contour of the pipe sections 2 and 2'. The jacket 14 has the above-mentioned opening 15 at least in the region between the leading ring 11 and the support portion 4, through which the planing tool 3 extends and through which the excess material removed by the planing tool 3 can enter the interior of the planing tool support 1.

The leading end ring 11 of the planing tool support 1 has a forwardly extending guiding sleeve 27 which is adapted to circumferentially surround the trailing end of the trailing pipe section 2 when the support 1 is assembled therewith.

In order to render possible the adjustment of the position of the leading end of the leading pipe section 2' of the second line of consecutive pipe sections, after the removal of the excess material 16 by the planing tool 3, a plurality of supports 28 is connected to the trailing end ring 12 of the planing tool support 1, and a corresponding number of rollers 29 of steel or the like is supported on the supports 28, such rollers being arranged, consequently, between the trailing end ring 12 of the planing tool support 1 and the leading end of the leading pipe section 2'. The leading pipe section 2' may be equipped with an end ring 23, and connected thereto by means of connecting sleeve 30, so that the rollers 29 may be in rolling contact with the end ring 23 rather than directly with the leading end of the pipe section 2'.

In addition thereto, the arrangement may include an adjustable cylinder-and-piston unit 20 which extends between the planing tool support 1 and the leading pipe section 2', which unit 20 serves to adjust the position of the pipe section 2' relative to the planing tool support 1. More particularly, the cylinder-and-piston unit 20 may be mounted on a bracket 21 which is rigid with the planing tool support 1, at one of its ends and with another bracket 22 which may either rest directly against the pipe section 2', or against an additional bracket 32, possibly being connected thereto by means of screws or the like, which additional bracket 32 is connected to the ring 23.

At least the leading section 2' of the second line of consecutive pipe sections is provided with an injection nozzle 24 communicating the interior of the pipe section 2' with a space 31 existing between the correctly positioned pipe section 2' and the boundary of the path which has been previously established by advancing the pipe sections 2. Filling or cementing material may then be introduced into the space 31 through the injection nozzle 24. The removed excess material 16 can be introduced into the space 31 through the interior of the planing tool support 1, as indicated by arrows, and may be solidified in the space 31 by introducing the cementing material into the space 31 through the nozzle 24, which cementing material then bonds the particles of the so deposited excess material 16. The cementing material may be a cement suspension or the like.

In order to be able to also attend to removal of excess material from the lateral regions of the planing tool support 1, additional planing tools 25 may be adjustably mounted on the planing tool support 1 upwardly of the inclined lower planing tool 3, such planing tools 25 extending laterally beyond the jacket 14 through circumferentially extending slots 26 provided therein.

The operation of the arrangement of the present invention has already been partly described when discussing the arrangement. However, the following recapitulation may be useful for understanding the present invention.

The line of consecutive pipe sections 2, of which only part of one is illustrated, is advanced through the ground in a well-known manner, in a path which deviates from the desired course of the underground passage whenever the pipes 2 encounter an obstruction during the advancement in direction of the arrow 17. As a result of such deviation or deviations, regions of excessive material 16 are encountered along the length of the underground passage between the actual path of advancement of the pipe sections 2 and the desired course of the passage. The planing tool support follows the trailing end of the line of consecutive pipe sections 2, and the planing tool 3 mounted on the planing tool support 1 extends transversely beyond the outer contour of the pipe sections 2 and that of the planing tool support 1 to the desired extent, depending on the amount of excess material 16 to be removed at any given location of the passage. The second line of consecutive pipe sections 2' immediately follows the planing tool support 1, advancing the same and also the pipe sections 2 in a well-known manner utilized in the advancing process, the second line of consecutive pipe sections 2' being gradually supplemented with further pipe sections 2' at its trailing end as the advancement of the sections 2, 2' and of the planing tool support 1 progresses.

The excess material 16 which is removed by the planing tool 3, predominantly from the region underneath the pipe sections 2, passes through the interior of the planing tool support 1 and is deposited in the space 31, and solidified therein by introduction of the cementing material, such as cement suspension, into the deposited excess material 16. The nozzle 24 is very useful for injecting the cementing material into the space 31; however, it could also be dispensed with, in which case only an opening could be provided in the pipe section 2' for the passage of the cementing material therethrough.

The advancing process of establishing an underground passage is usually performed by digging or otherwise providing two substantially vertical shafts or wells at a certain distance from each other, such distance corresponding to the length of the line of consecutive pipe sections which can be faultlessly advanced through the ground. If the distance to be spanned by the underground passage is longer than this distance between the two shafts or wells, the advancing process is repeated between the second shaft or well and a third shaft or well, and so on. Under these circumstances, and particularly when the distance to be spanned corresponds to the distance between only two of the shafts or wells, it is advantageous to remove the pipe sections from the leading end of the line of pipe sections 2 through the destination shaft or well, transport the pipe sections 2 back to the original or starting shaft or well, and supplement the line of consecutive pipe sections 2' by such transported pipe sections 2.

As already mentioned previously, the planing tool sections **3*a*, 3*b* and 3*c* of the planing tool 3 can be adjusted in their position in such a manner that they individually extend to the required extent beyond the outer contour of the planing tool support 1 so as to be able to remove all of the excess material 16 present at any given location of the underground passage. When the planing tool 3 is itself insufficient for removing the obstruction which caused the deviation of the line of consecutive pipe sections 2 from the desired course, that is, if the obstruction is a boulder of substantial dimension and weight, a rock or the like, it is possible, given sufficient dimension of the underground passage and of the pipe sections 2 and 2', to remove such obstruction by utilizing compressed air hammers or similar conventional procedure after which the particles which are obtained during such mechanical disintegration operation can also be deposited in the space 31**.

In order to avoid an undesirable upward movement of the downstream line of consecutive pipe sections 2', the cylinder-and-piston unit 20 which is arranged between the planing tool support 1 and the ring 23 connected to the pipe section 2' is always maintained under such pressure that the leading end of the leading pipe section 2' is pressed in the downward direction to thereby exactly follow the desired course of the underground passage which has been established by the planing tool 3 by its removal of the excess material 16.

It will be understood that each of the elements described above, or two or more together, may also find a useful application in other types of constructions differing from the types described above.

While the invention has been illustrated and described as embodied in a method and an arrangement for establishing an underground passage in the advancing process, it is not intended to be limited to the details shown since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method of correcting the course, particulaly the slope, of an elongated underground conduit that includes an original line of consecutive pipe sections of given transverse diemensions embedded in a surrounding material and follows a desired course except for at least one region where the conduit follows a deviating course, the method comprising the steps of aligning a leading end of an additional line of consecutive pipe sections of the given transverse dimensions with one end of the original line; advancing the lines until the leading end of the additional line reaches the one region; removing the surrounding material present between the boundaries of the deviating and desired courses at the one region; and so continuing the advancement of the lines that the additional line follows the desired course even through the one region.

2. A method as defined in claim 1, wherein said removing step includes severing the surrounding material by using at least one severing tool arranged between the one end of said original line and the leading end of said additional line.

3. A method as defined in claim 2, wherein said severing includes advancing the severing tool shaped as a planing tool together with said lines.

4. A method as defined in claim 1; and further comprising the step of depositing the severed surrounding material in a space between said additional line and the boundary of said actual course.

5. A method as defined in claim 4; and further comprising the step of stabilizing the deposited material in said space.

6. A method as defined in claim 5, wherein said stabilizing step includes introducing a cementing material into said space to penetrate into the deposited material.

7. A method as defined in claim 1; and further comprising the steps of removing pipe sections from the leading end of said original line, transporting the removed sections to the trailing end of said additional line, and adding the transported pipe sections to said trailing end for advancement with said additional line.

* * * * *